US010842284B1

(12) United States Patent
Huaman

(10) Patent No.: US 10,842,284 B1
(45) Date of Patent: Nov. 24, 2020

(54) FOOT SUPPORT PLATFORM

(71) Applicant: Cristian Alfonso Huaman, Saint Cloud, FL (US)

(72) Inventor: Cristian Alfonso Huaman, Saint Cloud, FL (US)

( * ) Notice: Subject to any disclaimer, the term of this patent is extended or adjusted under 35 U.S.C. 154(b) by 0 days.

(21) Appl. No.: 16/663,734

(22) Filed: Oct. 25, 2019

(51) Int. Cl.
*A47C 20/00* (2006.01)
*A47C 7/50* (2006.01)
*A47C 7/52* (2006.01)

(52) U.S. Cl.
CPC ..... *A47C 20/021* (2013.01); *A47C 7/50* (2013.01); *A47C 7/506* (2013.01); *A47C 7/52* (2013.01)

(58) Field of Classification Search
CPC ..... A47C 20/021; A47C 17/86; A47C 7/52; A47C 7/506; A47C 7/50; A47C 16/02; A47C 16/025; A47C 20/02; A47C 20/022; A47C 20/023; A47C 20/025; A47B 23/00
See application file for complete search history.

(56) References Cited

U.S. PATENT DOCUMENTS 5,408,710 A * 4/1995 Garman ..... A47C 7/52 297/423.3
6,101,652 A * 8/2000 Matern, Jr. ..... A47C 15/008 5/648
9,414,983 B1 * 8/2016 Loli ..... A61G 13/1235

* cited by examiner

*Primary Examiner* — Eric J Kurilla
*Assistant Examiner* — Amanda L Bailey
(74) *Attorney, Agent, or Firm* — Tiffany C. Miller; Inventions International Inc.

(57) ABSTRACT

An adjustable foot support platform configured to be extendable from at least one side of a bed having a mattress and its supporting structure. In particular, the foot support plate is configured for placement below a mattress and above its supporting structure. The foot support plate may be hingedly pivotable to orient the foot support plate from a parallel orientation in relation to the mattress and its supporting structure to a perpendicular orientation in relation to the mattress and its supporting structure. A user may place their foot on the foot support plate while they are seated upon the mattress of the bed.

1 Claim, 5 Drawing Sheets

FOOT SUPPORT PLATFORM

BACKGROUND OF THE INVENTION

1. Field of the Invention

This invention relates, generally, to a foot support platform. More particularly, it relates to an adjustable foot support platform configured to be extendable from at least one side of a bed having a mattress and its supporting structure.

2. Background Art

It is common for an individual to sit on furniture or to sit on the floor while accessing their lower extremities such as their feet while including, but not limited to, painting their nails, putting on socks, putting on shoes, or dressing a wound. For example, if a user sits on a chair or the edge of a bed, a user would have to bend down to reach their feet which may be uncomfortable or difficult for someone who is elderly. In another example, if a user sits on the floor to put their shoes on, it may be difficult for the individual to get back into a standing position or the individual may expose their clothing to dirt or debris from the floor. In another example, if a user sits on the edge of a bed to put their shoes on, their bent knee would position the individual's foot or shoe on a contact surface of the bed including but not limited to, a mattress, a mattress cover, a blanket, a comforter, a duvet, or a quilt, which may introduce germs to the contact surface. Thus, there is a long felt, yet unfulfilled need for a device capable of orienting a user's foot at a height great enough for a user to access their foot while sitting on their bed without requiring a user to bend down or requiring a user's foot or shoe to come into contact with a contact surface of the bed.

Currently, surgical tables, medical exam tables, and medical beds having a variety of foot support devices connected thereto are known. For example, a patient bed can have a non-pivotal actuation mechanism for a foot deck configured to assist the bed in being converted to a chair bed. Other patient beds can have an adjustable foot section having a length dimension defined along a longitudinal axis of the bed frame and a width dimension defined transverse to the longitudinal axis of the bed frame. Some hospital beds are known to have an adjustable length deck and a mattress positionable on the deck. Some examination tables are known to have conventional stirrups or stirrups fitted with boots connected thereto. The beds in these aforementioned examples require many parts and are intricate and complex to use because they are configured to be operated within a hospital setting. Thus, there is a need for an adjustable foot support platform easily configured to be extendable from at least one side of a bed having a mattress and its supporting structure.

However, in view of the prior art considered as a whole at the time the present invention was made, it was not obvious to those of ordinary skill in the pertinent art how the identified needs could be fulfilled.

SUMMARY OF THE INVENTION

There is a long-standing but heretofore unfulfilled need for an adjustable foot support platform configured to be extendable from at least one side of a bed having a mattress and its supporting structure. In particular, the foot support plate is configured for placement below a mattress and above its supporting structure. The foot support plate may be hingedly pivotable to orient the foot support plate from a parallel orientation in relation to the mattress and its supporting structure to a perpendicular orientation in relation to the mattress and its supporting structure. A user may place their foot on the foot support plate while they are seated upon the mattress of the bed, which also includes improvements that overcome the limitations of prior art foot support platforms is now met by a new, useful, and non-obvious invention.

In a preferred embodiment the novel foot support platform is mounted between a mattress and a supporting structure of a bed. A plate is located between a mattress and a supporting structure of a bed. The plate has rigidity capable of supporting a user's foot. The plate has a first end located opposite a second end. The first end of the plate has a protruding portion. The protruding portion of the plate is configured to support the foot of a user when the plate is extended from at least one side of the bed. The plate can have a protective covering such as a water resistant material or may have a foam layer for comfort. The plate has a length capable of having a portion of the first end extend from beyond the edge of a bed when in use while the second end of the plate is retained between the bed mattress and its supporting structure. The plate is simple pulled out when needed for use and pushed back between the bed mattress and its supporting structure when stored.

In a second embodiment, the foot support platform of the preferred embodiment has a second end of a plate having a fulcrum point being a fastener oriented through an opening of the plate. The fastener includes, but is not limited to a screw, and is anchored through a fastener receiving opening of the supporting structure and into the supporting structure. The fulcrum point facilitates the plate to be hingedly pivotable at the fulcrum point to position the protruding portion of the first end of the plate to extend from at least one side of the bed when oriented in a first position during use or to not extend from at least one side of the bed when oriented in a second position during storage.

In a third embodiment, the foot support platform has a second end of the plate received by an opening of a receiving structure. In particular, the receiving structure has a first end having a plate receiving opening located opposite a second end having a fastener opening. The receiving structure has a fulcrum point located at the second end of the receiving structure. The fulcrum point is a fastener oriented through the fastener opening of the receiving structure. The fastener is anchored into the supporting structure of the bed. The receiving structure is hingedly pivotable at the fulcrum point to position the protruding portion of the plate to extend from the side of the bed during use or to not extend from the side of the bed during storage. The receiving structure has a chamber retaining at least a portion of the plate when the second end of the plate is received by the receiving structure opening. The plate slidably traverses at least a portion of a length of the receiving structure. The protruding portion of the plate slidably traverses the receiving structure in an extended orientation beyond an outer perimeter edge of the bed when in use. The plate slidably traverses the receiving structure in a retracted orientation when at least a portion of said plate is retracted into the receiving structure, thereby orienting the protruding structure to not extend beyond the outer perimeter edge of the bed during storage. It is envisioned in this particular embodiment that the foot support platform is both hingedly pivotable at a fulcrum point of a receiving structure and slidably traverses at least a portion of a length of the receiving structure.

In a fourth embodiment, the foot support platform has a second end of the plate that is received by an opening of a receiving structure. The receiving structure has an L-shaped anchoring structure configured to abut at least one side of the supporting structure of the bed that is located opposite the protruding portion of the plate. In particular, the receiving structure has a first end having an opening located opposite a second end having an L-shaped anchoring structure. The L-shaped anchoring structure is oriented perpendicular to the opening of the receiving structure. The opening of the receiving structure receives the second end of the plate. The receiving structure has a chamber retaining at least a portion of the plate when the second end of the plate is received by the receiving structure opening. The plate slidably traverses at least a portion of a length of the receiving structure. The protruding portion of the plate is configured to be positioned in an extended orientation beyond an outer perimeter edge of the bed when in use. The plate is configured to be positioned in a retracted orientation when at least a portion of the plate is retracted into the receiving structure, thereby orienting the protruding structure to not extend beyond the outer perimeter edge of the bed during storage.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1A:
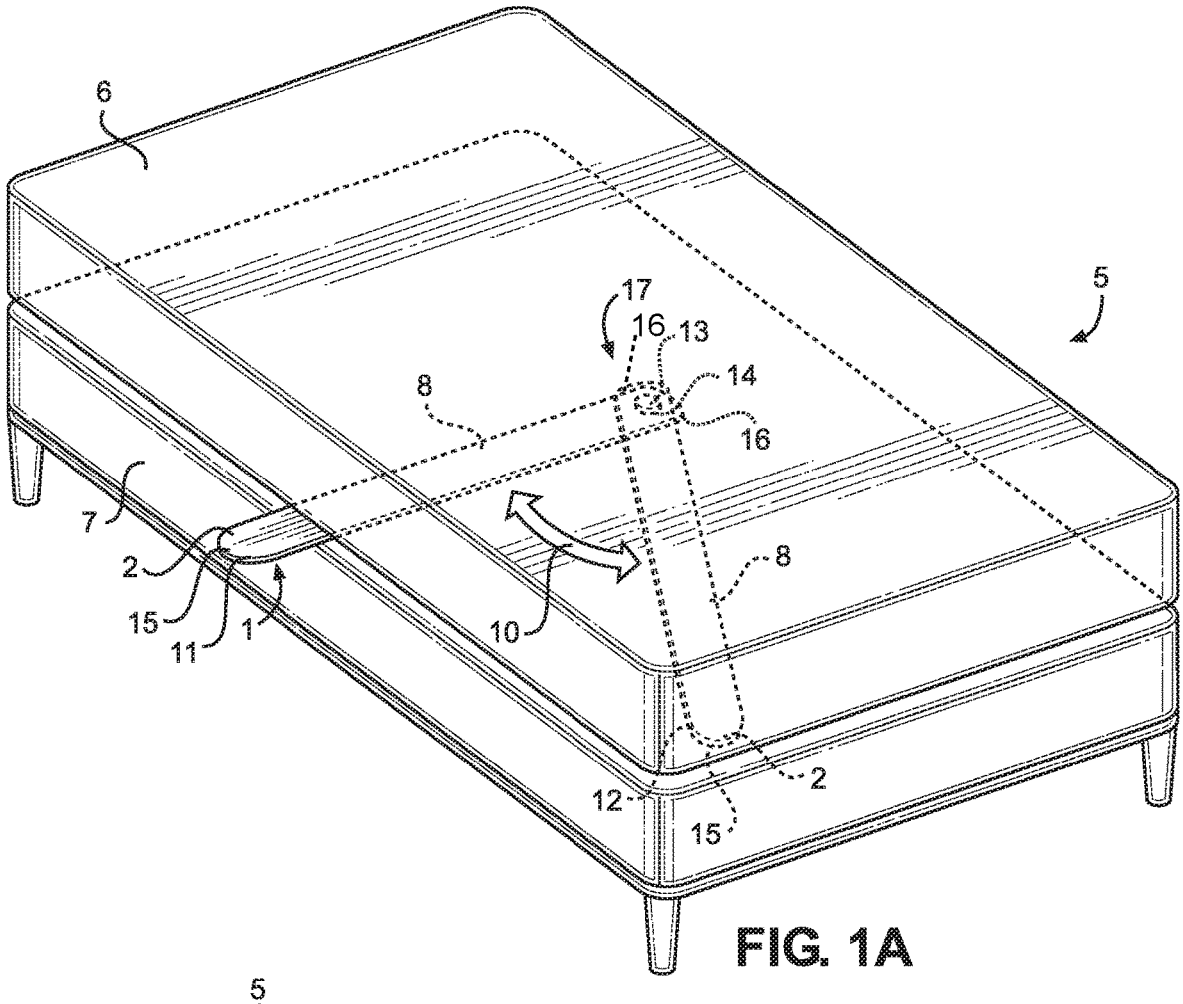
FIG. 1A is a perspective view of the preferred embodiment and features described in the second embodiment of the novel foot support platform having a plate located between the mattress and its supporting structure with a first end of the plate having a protruding portion located opposite a second end of the plate having a fulcrum point being a fastener oriented through an opening of the plate and anchored into the supporting structure of the bed, the foot support platform can be hingedly pivotable at a fulcrum point to position the protruding portion of the plate to extend from the side of the bed during use or to not extend from the side of the bed during storage.
Figure 1B:
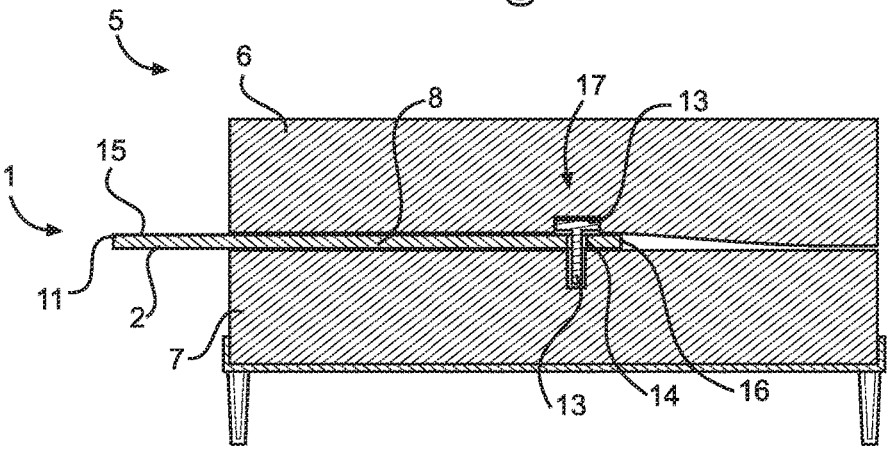
FIG. 1B is a side cut-away view of the preferred embodiment and features described in the second embodiment of the novel foot support platform having a plate located between the mattress and its supporting structure with a first end of the plate having a protruding portion located opposite a second end of the plate having a fulcrum point being a fastener oriented through an opening of the plate and anchored into the supporting structure of the bed.
Figure 2:
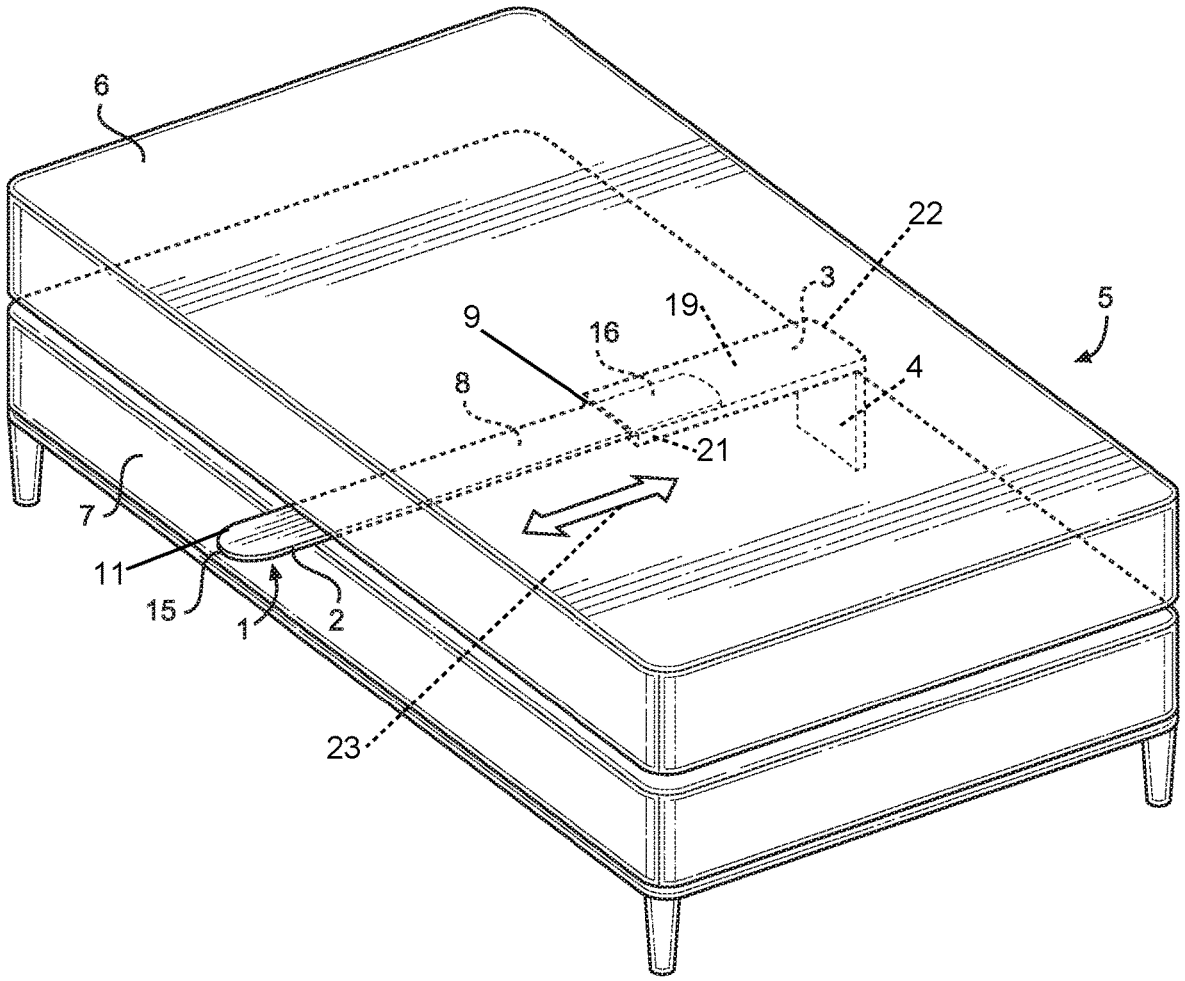
FIG. 2 is a perspective view of a fourth embodiment of the novel foot support platform having a plate located between the mattress and its supporting structure with a first end of the plate having a protruding portion located opposite a second end of the plate received by an opening of a receiving structure having an L-shaped anchoring structure.
Figure 3A:
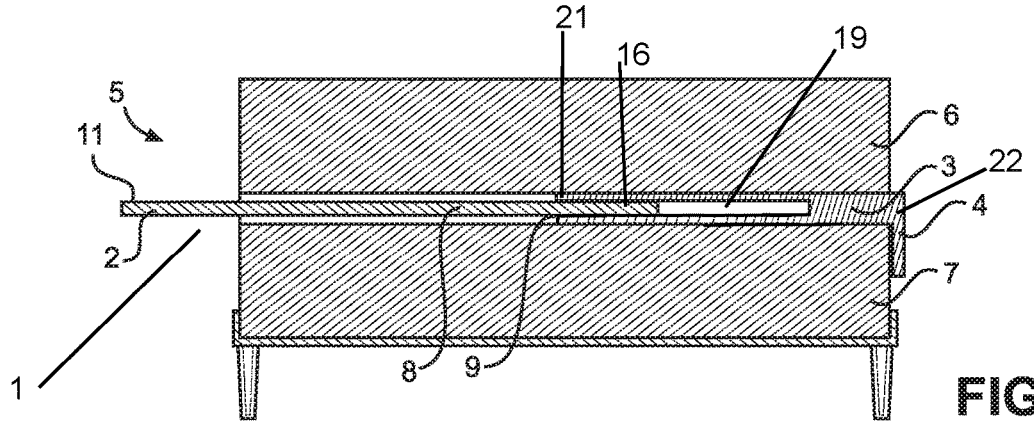
FIG. 3A is a side cut-away view of a fourth embodiment of the novel foot support platform having a plate located between the mattress and its supporting structure with a first end of the plate having a protruding portion located opposite a second end of the plate received by an opening of a receiving structure having an L-shaped anchoring structure, the foot support platform has a protruding structure extending beyond the outer perimeter edge of the bed when in use.
Figure 3B:
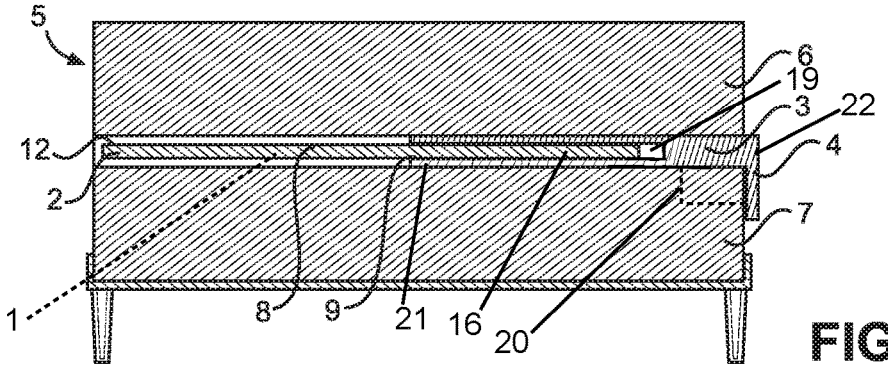
FIG. 3B is a side cut-away view of a fourth embodiment of the novel foot support platform having a plate located between the mattress and its supporting structure with a first end of the plate having a protruding portion located opposite a second end of the plate received by an opening of a receiving structure having an L-shaped anchoring structure, the foot support platform has a protruding structure retracted into the receiving structure so that the protruding structure does not extend beyond the outer perimeter edge of the bed during storage.
Figure 4:
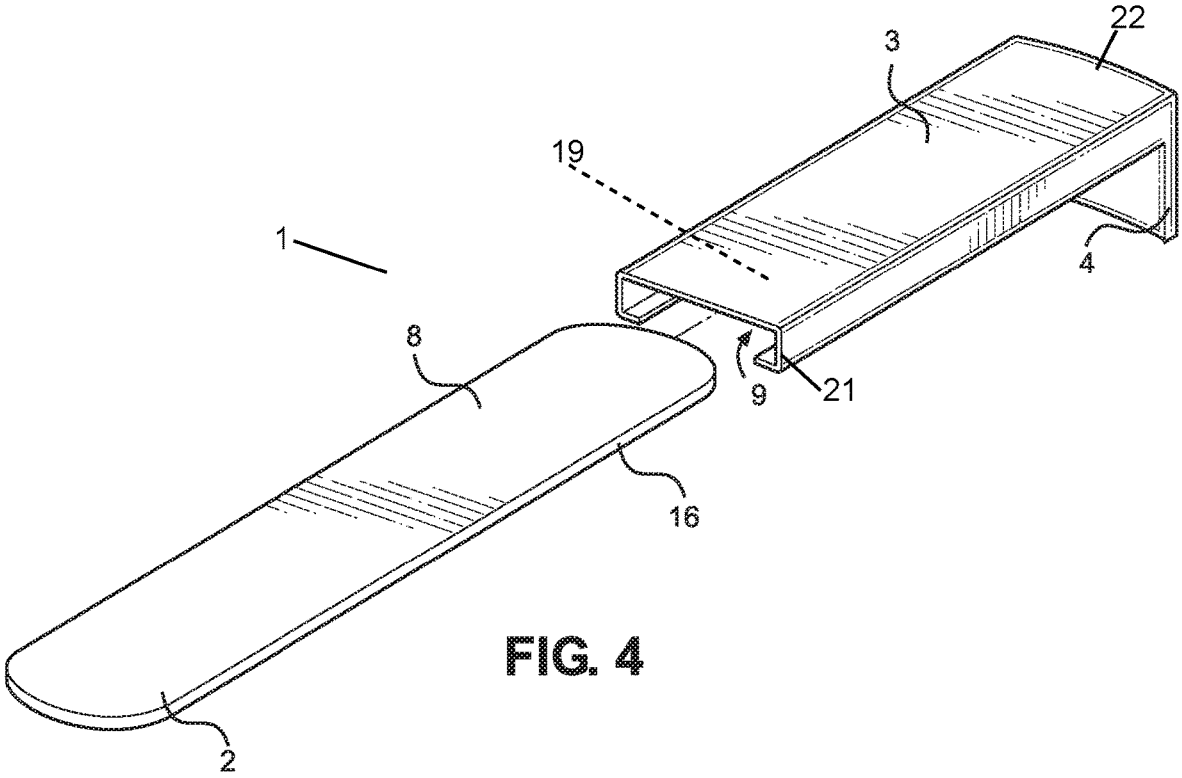
FIG. 4 is an exploded view of a fourth embodiment of the novel foot support platform having a plate with a first end of the plate having a protruding portion located opposite a second end of the plate received by an opening of a receiving structure having an L-shaped anchoring structure.

Referring to FIGS. 1A and 1B, a preferred embodiment of novel foot support platform 1 has plate 8. Plate 8 has a first end 15 located opposite a second end 16. Plate 8 is located between mattress 6 and supporting structure 7 of bed 5. It is within the scope of this current invention for supporting structure 7 to include, but not be limited to, a box spring or a bed frame. Plate 8 has first end 15 having protruding portion 2 configured to support a user's foot (not shown) when a user is sitting on the mattress 6 of bed 5. Plate 8 has second end 16. In a second embodiment, the preferred embodiment of foot support platform 1 has plate 8 with second end 16 having opening 14. Opening 14 receives fastener 13. Fastener 13 anchors or connects plate 8 onto supporting structure 7 of bed 5, forming fulcrum point 17. Plate 8 is capable of pivoting 10 (FIG. 1A) at fulcrum point 17 to orient protruding portion 2 of plate 8 to extend 11 from the outer perimeter edge of bed 5 when oriented in a first position 11 during use or to orient protruding portion 2 to not extend 12 (FIG. 1A) from the outer perimeter edge of bed 5 at a second position 12 (FIG. 1A) during storage. As best shown in FIG. 1A, when protruding portion 2 does not extend 12 from the outer perimeter edge of bed 5 during storage, the protruding portion 2 is concealed between mattress 6 and supporting structure 7 of bed 5.

FIGS. 2, 3A, 3B, and 4 illustrate a fourth embodiment of foot support platform 1 in which plate 8 is not pivotable at a fulcrum point, but is capable of traversing 23 (FIG. 2) at least a portion of a rod or receiving structure 3 to orient the protruding portion 2 of plate 8 to extend from 11 (FIGS. 2 and 3A) the outer perimeter edge of bed 5 (FIGS. 2, 3A, and 3B) during use or to orient protruding portion 2 to retract or to not extend 12 (FIG. 3B) from the outer perimeter edge of bed 5 during storage. Receiving structure 3 may have an L-shaped anchoring structure 4. The L-shaped anchoring structure 4 is configured to have an end abutting at least a portion of supporting structure 7 of bed 5. It is within the scope of this current invention for L-shaped anchoring structure to have an angle 20 (FIG. 3B) of approximately 90 degrees. Foot support platform 1 is located between mattress 6 and supporting structure 7 of bed 5. The L-shaped anchoring structure 4 is fitted against the side of supporting structure 7 of bed 5.

As depicted in FIGS. 2, 3A, 3B, and 4, receiving structure 3 has a first end 21 having plate receiving opening 9 located opposite second end 22 having an L-shaped anchoring structure 4. L-shaped anchoring structure 4 is oriented perpendicular to the plate receiving opening 9 of receiving structure 3. Plate receiving opening 9 of receiving structure 3 receives second end 16 of plate 8. Receiving structure 3 has chamber 19 retaining at least a portion of plate 8 when second end 16 of plate 8 is received by plate receiving opening 9 of receiving structure 3.

Figure 5A:
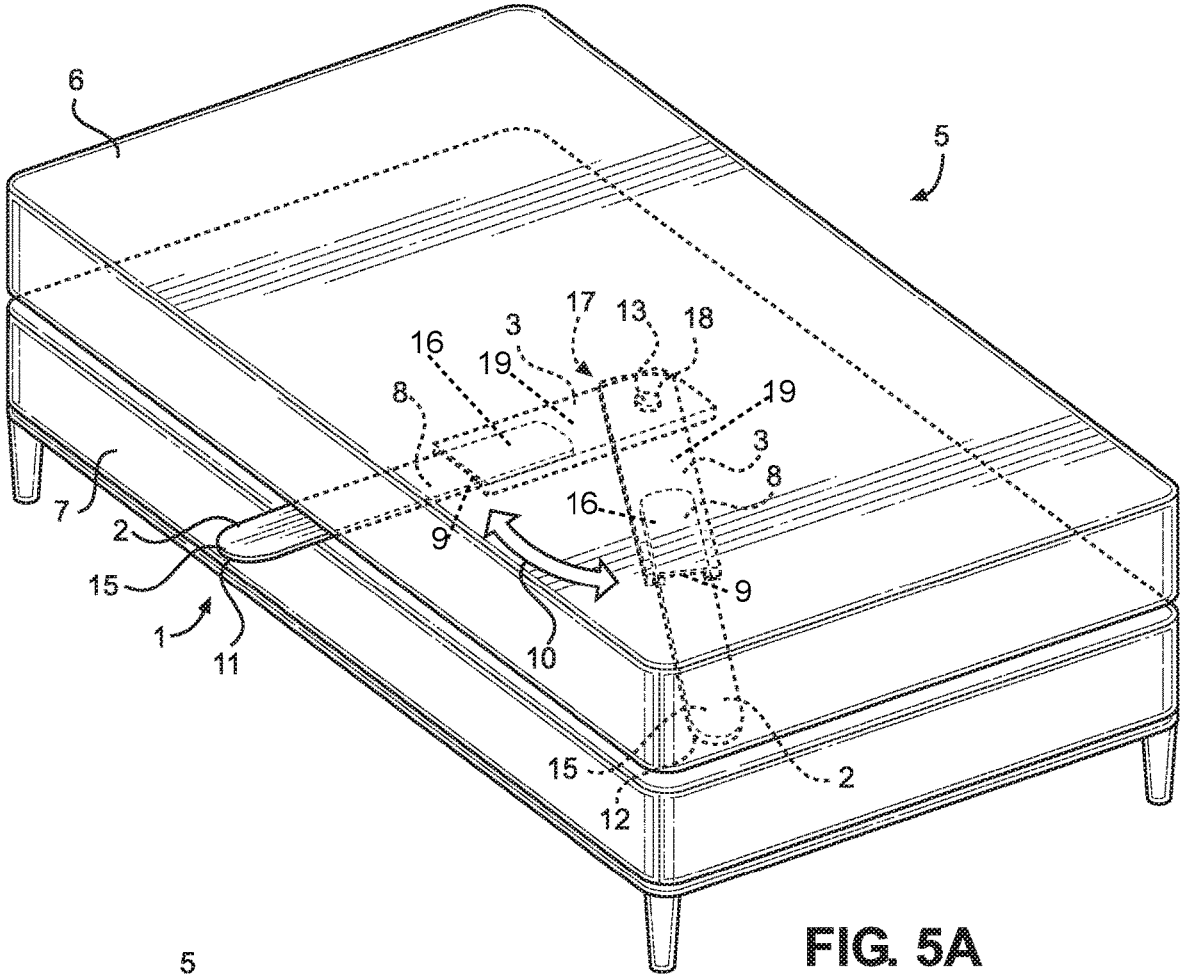
FIG. 5A is a perspective view of a third embodiment of the novel foot support platform having a plate located between the mattress and its supporting structure with a first end of the plate having a protruding portion located opposite a second end of the plate received by an opening of a receiving structure, the receiving structure having a fulcrum point being a fastener oriented through an opening of the receiving structure and anchored into the supporting structure of the bed, the foot support platform can be hingedly pivotable at a fulcrum point to position the protruding portion of the plate to extend from the side of the bed during use or to not extend from the side of the bed during storage.
Figure 5B:
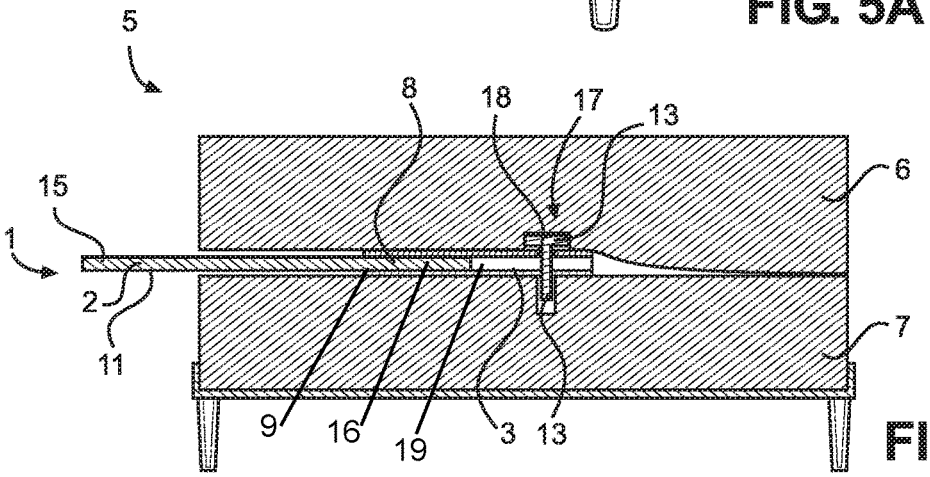
FIG. 5B is a side cut-away view of a third embodiment of the novel foot support platform having a plate located between the mattress and its supporting structure with a first end of the plate having a protruding portion located opposite a second end of the plate received by an opening of a receiving structure, the receiving structure having a fulcrum point being a fastener oriented through an opening of the receiving structure and anchored into the supporting structure of the bed; and, FIG. 5C is an exploded view of a third embodiment of the novel foot support platform having a plate located between the mattress and its supporting structure with a first end of the plate having a protruding portion located opposite a second end of the plate received by an opening of a receiving structure, the receiving structure having a fulcrum point being a fastener oriented through an opening of the receiving structure and anchored into the supporting structure of the bed.
Figure 5C:
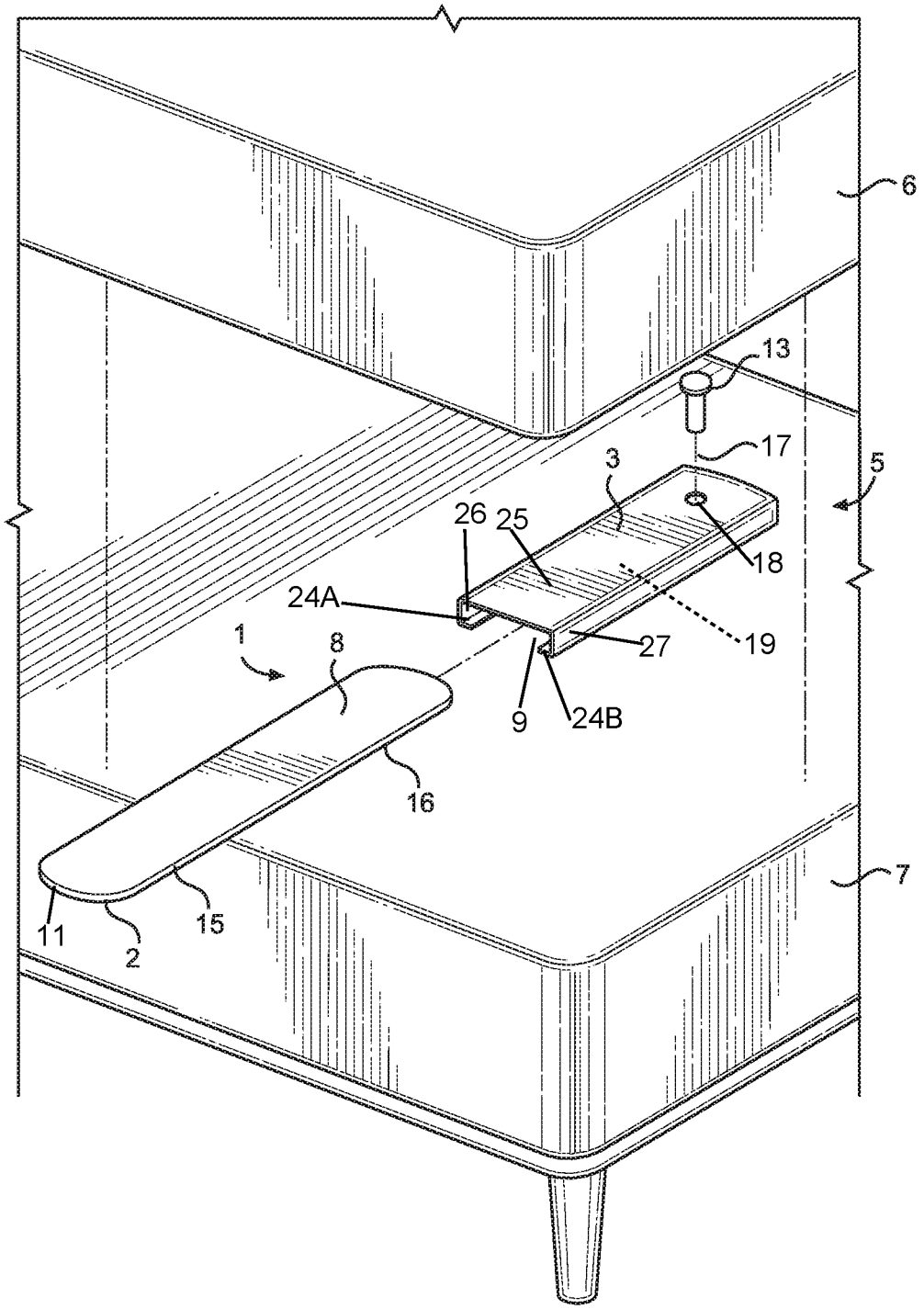

Alternatively, FIGS. 5A, 5B, and 5C illustrate a third embodiment of foot support platform 1 having receiving structure 3 without an L-shaped anchoring structure 4. Novel foot support platform 1 has plate 8 located between mattress 6 and its supporting structure 7 of bed 5. First end 15 of plate 8 has a protruding portion 2 located opposite second end 16 of plate 8. Second end 16 of plate 8 is received by plate receiving opening 9 of receiving structure 3. Receiving structure 3 has fulcrum point 17 being fastener 13 oriented through opening 18 of receiving structure 3 and anchored into supporting structure 7 of bed 5. Receiving structure 3 of foot support platform 1 can be hingedly pivotable 10 (FIG. 5A) at fulcrum point 17 to position protruding portion 2 of plate 8 to extend 11 from the side of bed 5 during use or to not extend 12 (FIG. 5A) from the side of bed 5 during storage. FIG. 5C illustrates receiving structure 3 having top wall 25. Top wall 25 is connected to first sidewall 26 and second sidewall 27. First sidewall 26 is connected to first flange 24A. Second sidewall 27 is connected to second flange 24B. Top wall 25, first sidewall 26, second sidewall 27, first flange 24A, and second flange 24B form chamber 19. Further, at least a portion of plate 8 may slidably traverse at least a portion of the length of chamber 19 of receiving structure 3 to orient protruding portion 2 of plate 8 to extend beyond the outer perimeter edge or side of bed 5 when in use or to retract at least a portion of plate 8 into chamber 19 of receiving structure 3 during storage when protruding portion 2 of plate 8 does not extend beyond the outer perimeter edge of bed 5 or side of bed 5.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A foot support platform configured to be mounted between a mattress and a supporting structure of a bed, comprising:

a plate, said plate located between a mattress and a supporting structure of a bed, said plate having a first end located opposite a second end, said first end of said plate having a protruding portion, said protruding portion of said plate is configured to support the foot of a user when extended from at least one side of said bed;

a receiving structure, said receiving structure having a top wall, said top wall is connected to a first sidewall and a second sidewall, said first sidewall is connected to a first flange, said second sidewall is connected to a second flange, thereby forming a chamber, said receiving structure has a first end having a plate receiving opening located opposite a second end having a fastener opening, said receiving structure has a fulcrum point located at said second end of said receiving structure, said chamber of said receiving structure retaining at least a portion of said plate when said second end of said plate is received by said plate receiving opening of said receiving structure; and, said receiving structure having a fulcrum point being a fastener oriented through said fastener opening of said second end of said receiving structure, said fastener is anchored into said supporting structure of said bed, said receiving structure is hingedly pivotable at said fulcrum point to position said protruding portion of said plate to extend from said side of said bed during use or to not extend from said side of said bed during storage, said plate slidably traverses at least a portion of a length of said chamber of said receiving structure, said protruding portion of said plate slidably traverses said receiving structure in an extended orientation beyond an outer perimeter edge of said bed when in use, said plate slidably traverses said receiving structure in a retracted orientation when at least a portion of said plate is retracted into said receiving structure, thereby orienting said protruding structure to not extend beyond said outer perimeter edge of said bed during storage.

* * * * *